US006425139B1

(12) United States Patent
Ida

(10) Patent No.: US 6,425,139 B1
(45) **Date of Patent: *Jul. 30, 2002**

(54) WAIST ADJUSTING DEVICE

(75) Inventor: Kazuo Ida, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/649,618

(22) Filed: Aug. 29, 2000

(30) Foreign Application Priority Data

Aug. 31, 1999 (JP) ..... 11-246259
Aug. 31, 1999 (JP) ..... 11-246260
Dec. 27, 1999 (JP) ..... 11-371214

(51) Int. Cl.[7] ..... A41F 9/00
(52) U.S. Cl. ..... 2/325; 2/338
(58) Field of Search ..... 2/325, 323, 338, 2/311, 321, 322; 24/615, 306

(56) References Cited

U.S. PATENT DOCUMENTS 2,900,696 A * 8/1959 Bacon ..... 24/206
3,591,866 A * 7/1971 Jensen ..... 2/321
3,969,795 A * 7/1976 Stephenson ..... 24/203
4,133,082 A 1/1979 Kanzaka
4,338,706 A 7/1982 Aoki
4,688,337 A * 8/1987 Dillner et al. ..... 24/616
4,800,629 A * 1/1989 Ikeda ..... 24/170
4,930,324 A * 6/1990 Meier ..... 70/18
4,977,650 A * 12/1990 Ida ..... 24/614
5,319,836 A * 6/1994 Ida ..... 24/625
5,355,562 A * 10/1994 Matoba et al. ..... 24/625
5,440,792 A * 8/1995 Ida ..... 24/615
5,491,845 A * 2/1996 Takimoto ..... 2/338
5,572,747 A * 11/1996 Cheng ..... 2/322
5,687,455 A * 11/1997 Alexander ..... 24/16
6,052,875 A * 4/2000 Fudaki ..... 24/625
6,058,577 A * 5/2000 Ida et al. ..... 24/306
6,205,630 B1 * 3/2001 Mori ..... 24/633

FOREIGN PATENT DOCUMENTS

JP 07-079808 3/1995
JP 09-273013 10/1997
JP 09-296317 11/1997
JP 10-327909 12/1998

* cited by examiner

*Primary Examiner*—Gloria M. Hale
*Assistant Examiner*—Alissa L. Hoey
(74) *Attorney, Agent, or Firm*—Finnegan, Henderson, Farabow, Garrett & Dunner, LLP

(57) ABSTRACT

The present invention provides a waist adjusting device which allows reduction of the number of parts, an operating piece to exert its elastic performance accurately with respect to a slider body and a smooth engagement/disengagement operation. An adjusting belt has a plurality of adjusting protrusions provided on the surface thereof and a slider body has a through portion through which the adjusting belt is capable of being inserted to the right and left and further insertion holes in which an operating piece is inserted, provided on upper and lower portions of the slider body. Slope portions inclined outward are provided on both sides of the lower insertion hole. The operating piece has engaging protrusions on one face and elastic leg portions on both sides, provided integrally with a main body thereof. Ends of the elastic leg portion are brought into an elastic contact with the slope portions so that the operating piece is always urged upward so as to allow the adjusting protrusions and the engaging protrusions to engage with each other. By pressing the operating piece resisting an elastic force of the elastic leg portion, engagement between the adjusting protrusions and the engaging protrusions is released so as to adjust the length of the waist. When the operating piece is released, it is restored upward by an elastic force so that both the protrusions engage with each other. A prominent feature of this invention is that the operating piece can be moved smoothly by the slope portions and the elastic leg portions.

11 Claims, 21 Drawing Sheets

WAIST ADJUSTING DEVICE

BACKGROUND OF THE INVENTION

1. Field of the Invention

The present invention relates to a waist adjusting device generally called waist adjuster or belt adjuster, which is capable of adjusting the length of a waist belt in clothes, for example, beltless trousers or skirts.

2. Description of the Related Art

A conventional waist adjusting device will be described next. A slider is attached by means of a fixing device to a rear face of a waist belt located outside at an overlapping portion of for example, beltless trousers or skirt as shown in FIG. 9. Then, an adjusting belt having adjusting protrusions arranged at a predetermined interval or if the adjusting belt is attached on the rear face of a narrow foundation 12, both the adjusting belt and the narrow foundation 12 are inserted through the slider. Both ends of the adjusting belt or narrow foundation 12 are sewed to the waist belt 6 located inside and then, an operating piece having engaging protrusions capable of engaging the adjusting protrusions is inserted into the slider from above. Consequently, the adjustment of the length of the waist is carried out.

An example of the structure of the waist adjusting device has been disclosed in for example, Japanese Patent Laid-Open Publication No. 9-273013, as shown in FIG. 31. The adjusting belt 1' has a plurality of adjusting protrusions 11' provided at a predetermined interval on the surface thereof and the slider is comprised of a slider body 2' having a through hole 20' through which the adjusting belt 1' is passed and an operating piece 7' having engaging protrusions 72' capable of engaging with the adjusting protrusions 11' of adjusting belt 1'. The operating piece 7' is inserted into an insertion hole 36' in the slider body 2' by pressing perpendicular to the adjusting belt 1' inserted into the slider body 2'. The operating piece 7' inserted into the slider body 2' such that it is capable of coming in/out is urged in such a direction that it is protruded from the slider body 2' by a wound spring 76' mounted near an operating portion 74'.

In general, in the waist adjusting device of this kind, the slider is attached to a rear face of the waist belt located outside of the beltless trousers by means of the fixing device. The adjusting belt or both the adjusting belt and narrow foundation of which one end is fixed to the waist belt inside are inserted through the slider and then, free ends of the adjusting belt or adjusting belt and narrow foundation are sewed and fixed to the waist belt located inside. Therefore, a work for attaching the waist adjusting device to clothes such as the beltless trousers is very complicated and troublesome.

Particularly, the waist adjusting device shown in FIG. 35 is composed of an adjusting belt 1', slider body 2', operating piece 7', wound spring 76', and a fixing device 4' consisting of hook 42' and a washer 41', so that many components are used thereby leading to an increase in production cost. Further, it takes much time and labor for the production. Meanwhile, the operating piece 7' and elastic member are described to be formed by integral molding using resin, its specific configuration has not been explained clearly.

SUMMARY OF THE INVENTION

Accordingly, the present invention has been achieved in views of the above problems, and a first object of the invention is to provide a waist adjusting device which allows reduction of the number of components of a product to achieve reduction of production cost and allows the operating piece to exert its elastic performance with respect to a slider body so as to move smoothly, in which the slider body and operating piece can be produced very easily and which can be attached to clothes easily.

A second object of the present invention is to provide a waist adjusting device in which the adjusting belt or the adjusting belt and narrow foundation are attached to an inside waist belt by sewing both ends thereof and a slider fixed on the outside waist belt is attached to the adjusting belt whose both ends are fixed by deforming the slider elastically, thereby making it possible to assemble and attach the waist adjusting device very easily.

A third object of the present invention is to provide a waist adjusting device which can be attached easily to clothes such as beltless trousers and in which the slider can be divided to a surface plate and a rear plate, thereby making it possible to assemble and attach the waist adjusting device very easily. A further object is to provide a waist adjusting device which is composed of a slider which can be divided in different ways and which can be attached to the waist belt easily, so that not only assembly of the waist adjusting device can be carried out easily but also inventory thereof can be controlled easily.

A fourth object of the present invention is to provide a waist adjusting device which allows the operating piece to exert its elastic performance accurately so that the operating piece is capable of coming in and out with respect to the slider body appropriately.

A fifth object of the present invention is to provide a waist adjusting device which allows elasticity to be generated in the operating piece enabling an efficient actuation so that the operating piece is capable of coming in and out effectively.

A sixth object of the present invention is to provide a waist adjusting device which allows elastic leg portions provided to the operating piece to be elastically deformed in a stabilized state.

A seventh object of the present invention is to provide a waist adjusting device in which the operating piece is capable of sliding smoothly and accurately in a stabilized state without any deviation to the slider so that it is capable of coming in and out smoothly.

An eighth object of the present invention is to provide a waist adjusting device which allows the operating piece to exert its elastic performance effectively and accurately by forming the elastic leg portions provided on the operating piece so as not to collide with other member, for example, adjusting protrusions of the adjusting belt.

A ninth object of the present invention is to provide a waist adjusting device which can be produced easily by limiting the material of the waist adjusting device to thermoplastic resin, so that recycling of the material can be achieved.

A tenth object of the present invention is to provide a waist adjusting device which allows the slider body and fixing device to be produced very easily by specifying the configurations of the slider and fixing device, the waist adjusting device being suitable for molding of thermoplastic resin and capable of being attached firmly.

The other objects will be automatically understood by a following description.

To achieve the above object, according to the invention, there is provided a waist adjusting device, in which an adjusting belt has a plurality of adjusting protrusions on the surface thereof at a predetermined interval; a slider body contains a through portion through which the adjusting belt is capable of being inserted; attaching holes for attaching a fixing device are provided on a face of the through portion; insertion holes through which an operating piece is capable of being inserted are provided in upper and lower portions such that it is perpendicular to the through portion; slope portions are provided on both sides of a lower insertion hole; the operating piece has engaging protrusions capable of engaging with the adjusting protrusions provided on a face thereof and elastic leg portions provided integrally on both sides, the elastic leg portions making sliding contact with the slope portion and being capable of sliding thereon; and the operating piece is urged upward so as to allow the adjusting protrusions and the engaging protrusions to engage with each other. Consequently, the number of the components of the waist adjusting device can be reduced so that production cost can be also reduced. By cooperation between the slider body and operating piece, the operating piece is capable of exerting its elastic performance accurately. As a result, the operating piece is capable of coming in and out smoothly with respect to the slider body and further, the slider body and operating piece can be produced easily. Further, this waist adjusting device can be attached to clothes easily.

Preferably, the slider body has a gap portion provided in any one of top plate and bottom plate for connecting a surface plate and a rear plate to each other; and by elastically deforming the surface plate and the rear plate of the slider body so that the gap portion is expanded, the slider body can be mounted onto the adjusting belt of which both ends are fixed and which has the adjusting protrusions disposed at a predetermined interval. Consequently, part of the slider body can be separated and opened easily. Thus, the slider body can be attached later to the adjusting belt whose both ends are fixed. As a result, the later attachment type slider which has not been realized conventionally is achieved, so that production efficiency of clothes such as beltless trousers and Further preferably, the slider body may be comprised of a plate-like surface plate capable of being fixed to the waist belt and a plate-like rear plate capable of engaging with the surface plate; and fitting pieces are provided on any one of the surface plate and the rear plate and engaging pieces capable of engaging with the fitting pieces are provided on the other such that they oppose each other at top and bottom of the plates so that the surface plate and the rear plate are used separately to compose the slider body of the waist adjusting device. Consequently, attachment and assembly can be carried out very easily so that an effective attachment work is enabled. In case where the slider body is divided to the surface plate and the rear plate to be used, it is not necessary to stock a large amount of the surface plates and rear plates of the same combination for different type waist adjusting devices. By preparing diversified surface plates and rear plates different in color, pattern and type, it is possible to supply a waist adjusting device meeting user's demand.

Further preferably, the elastic leg portions are disposed from a central portion of the main body of the operating piece such that they extend in parallel to the main body along substantially the same length as the main body; the engaging protrusions are provided on the main body of the operating piece such that they are protruded; an operating portion of the operating piece is always kept to be protruded from the slider body; and small protrusions are provided so that they collide with an edge portion of the upper insertion hole to prevent removal of the operating piece, thereby providing reliably the elasticity with the operating piece by a simple structure. Consequently, the pressing operation of the pressing piece can be carried out easily so that it is capable of coming in and out appropriately with respect to the slider.

Also preferably, part of the main body of the operating piece is inserted into the lower insertion hole provided in the slider body; ends of the elastic leg portions are kept to be in contact with the slope portion and slightly opened; and the small protrusions for preventing removal of the operating piece are provided on side faces of the operating portion. Consequently, the operating piece is capable of exerting its elastic performance enabling an efficient actuation, so that it is capable of coming in and out effectively.

Further preferably, a side wall is provided on the slope portion of the slider body on the side of the surface plate so that a concave groove is formed as a whole; and the ends of the elastic leg portions of the operating piece are in contact with the concave groove and capable of sliding thereon. Consequently, the ends of the elastic leg portions can be operated in a stabilized condition without slipping out of the slope portion and nor wobbling, so that a smooth sliding motion is secured.

Preferably, the slider body is rectangular and has a rectangular through hole provided vertically in the center of a rear plate thereof; attaching holes whose inner portions are expanded are provided in the surface plate opposing the through hole; and a fixing device has attaching posts whose ends are capable of being inserted into the attaching holes and crushed, on a rear face of a cap. Consequently, the slider body can be produced very easily and particularly, is suitable for molding using thermoplastic resin. Further, the slider body can be attached to the waist belt firmly. It is preferable to dispose a vertical pair of attaching holes and attaching posts.

Also preferably, a protruded ridge is provided on an inner face of each of both edge portions along the vertically long through hole provided on the rear plate of the slider; and the operating piece has long grooves extending to lower ends along both sides of a through hole provided vertically in the center of the main body of the operating piece so that the long grooves are capable of engaging with the protruded ridges of the slider body. Consequently, the operating piece is guided in a stabilized condition without wobbling with respect to the slider body, so that the operating piece can slide in and out of the slider body smoothly.

Further preferably, the elastic leg portions provided on both sides of the operating piece are formed thinner than the surface of the main body having the engaging protrusions. Consequently, the elastic leg portions provided on the operating piece can be prevented from colliding with the adjusting protrusions of the adjusting belt by such a simple structure, so that the elastic performance can be exerted effectively and accurately.

Preferably, the adjusting belt, slider body, fixing device and operating piece are formed of thermoplastic resin by injection molding or extruding molding. Consequently, the waist adjusting device can be produced very easily and further recycled. That is, the effects which the present invention exerts are very remarkable.

DESCRIPTION OF THE PREFERRED EMBODIMENTS

Hereinafter, the preferred embodiment of the waist adjusting device of the present invention will be described with reference to the accompanying drawings.

Figure 8:
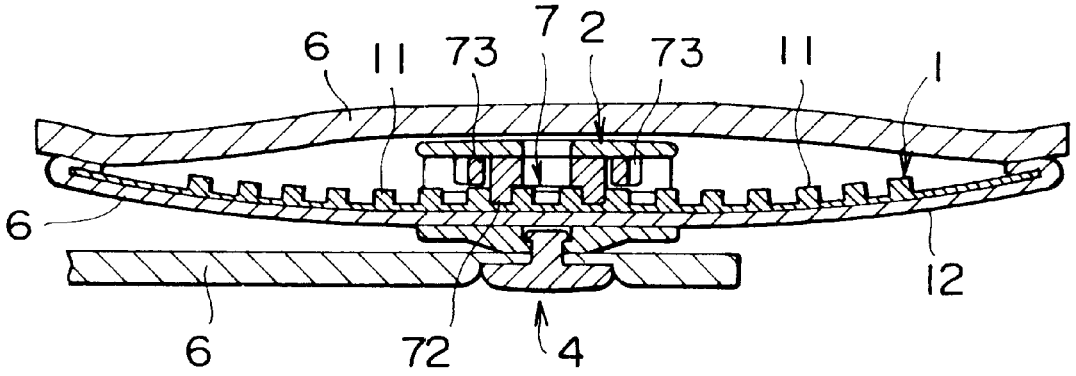
FIG. 8 is a cross sectional view showing the waist adjusting device of the first embodiment in use.
Figure 9:
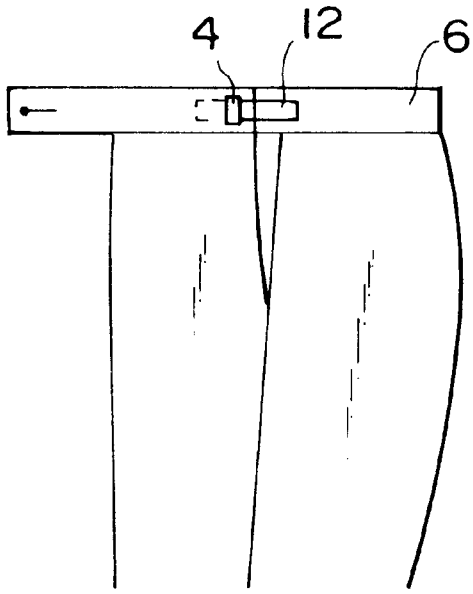
FIG. 9 is a front view showing the waist adjusting device of the first embodiment in use.

The waist adjusting device of the present invention is comprised of an adjusting belt 1, a slider body 2, an operating piece 7 and a fixing device 4. As shown in FIGS. 8 and 9, the slider body 2 containing the operating piece 7 is attached to an end of a waist belt 6 such as beltless trousers by means of the fixing device 4 such that the slider body 2 is located inside. Further, both ends of narrow foundation 12 having a small width are attached onto the waist belt 6 and the adjusting belt 1 is attached to a rear face of the narrow foundation 12. Then, the adjusting belt 1 is inserted into the slider body 2 and by pressing the operating piece 7, the slider body 2 is slid so as to adjust the length of the waist in the waist belt 6. The adjusting belt 1, slider body 2, operating piece 7 and fixing device 4 are formed by injection molding or extrusion molding using thermoplastic resin such as polyamide, polyacetal, polypropylene and polybutylene terephthalate.

If the adjusting belt 1 is formed thick, it is not always necessary to attach the narrow foundation 12 to the adjusting belt 1 and the adjusting belt 1 may be attached to the waist belt 6 solely. If the adjusting belt 1 is formed in the same color as cloth of the waist belt 6, the adjusting belt 1 becomes unobtrusive, which is preferable.

Figure 1:
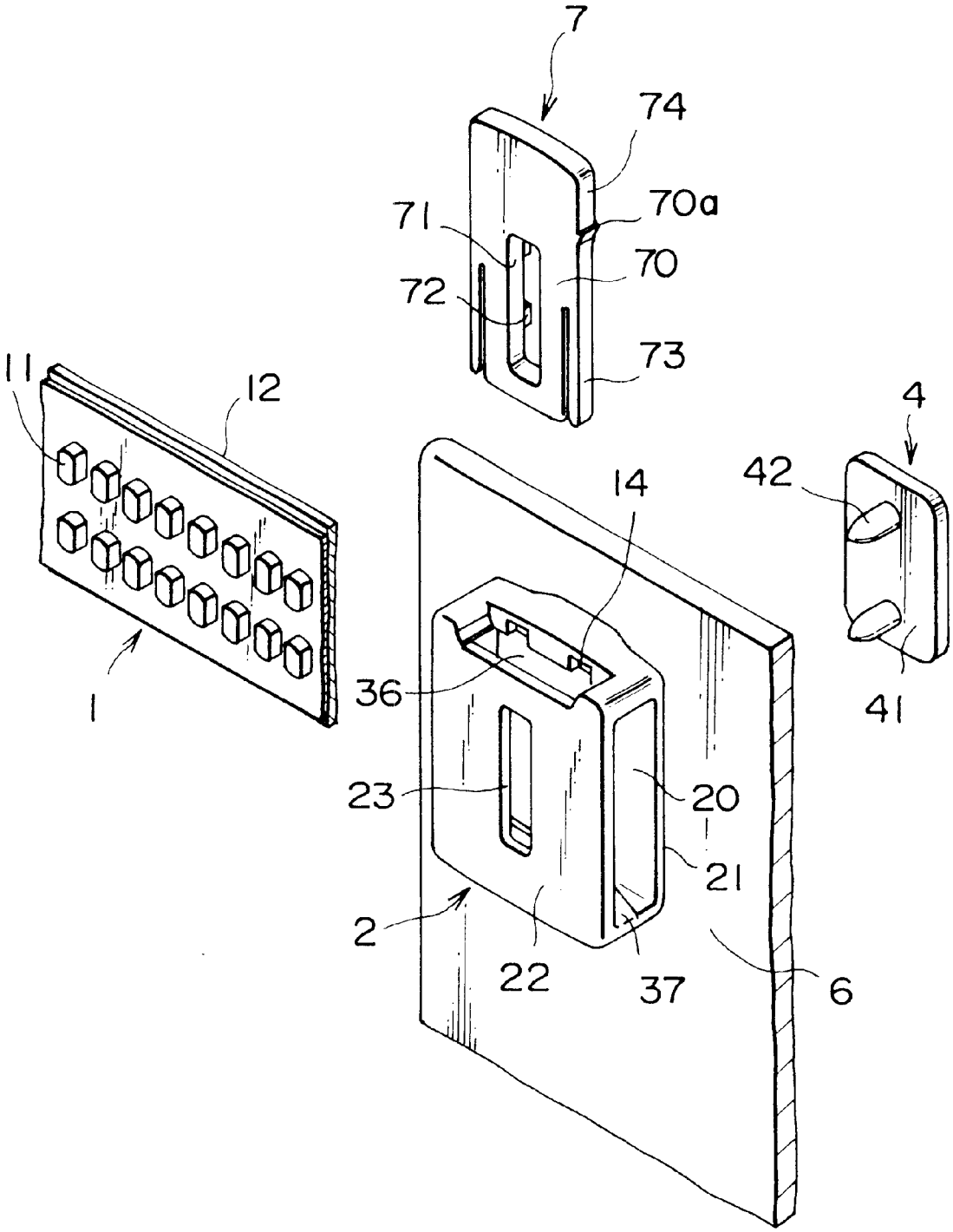
FIG. 1 is an exploded perspective view of a waist adjusting device according to a first embodiment of the present invention.
Figure 6:
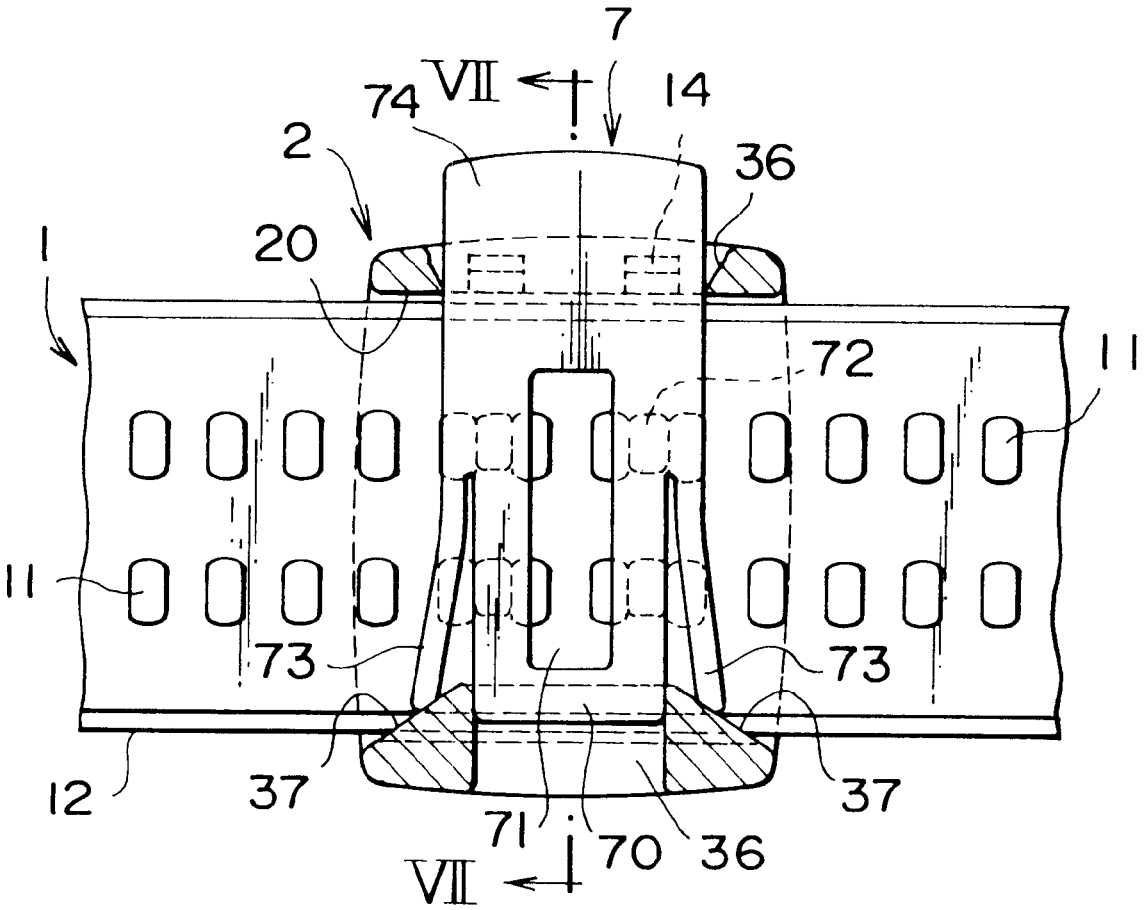
FIG. 6 is a sectional view taken along the line VI—VI in FIG. 7 of the waist adjusting device.
Figure 7:
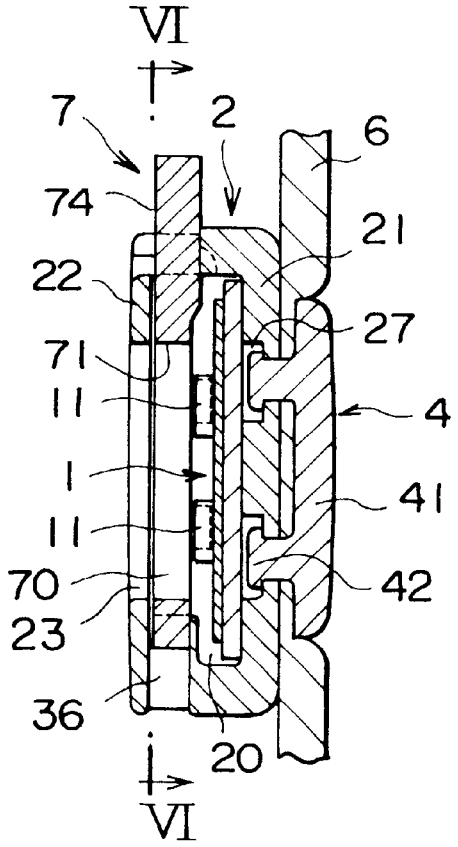
FIG. 7 is a sectional view taken along the line VII—VII in FIG. 6 of the waist adjusting device.

The adjusting belt 1 of the waist adjusting device is a long belt as shown in FIGS. 1, 6 and 7. Two rows of adjusting protrusions 11 are arranged so as to protrude at a predetermined interval on the surface of the belt and each of the adjusting protrusions 11 is formed in a rectangular shape, vertically long hexagonal shape or any shape in which both sides are parallel to each other. The adjusting belt 1 has entirely an elasticity while a rear face thereof is flat and is suitable for being attached to the narrow foundation 12 of the waist belt 6 of trousers, skirt or the like. Meanwhile, the adjusting protrusions 11 may be arranged so as to protrude in a single row at a predetermined interval on the surface of the adjusting belt 1. As a result, the sizes of the adjusting belt 1, slider body 2 and operating piece 7 can be reduced.

Figure 2:
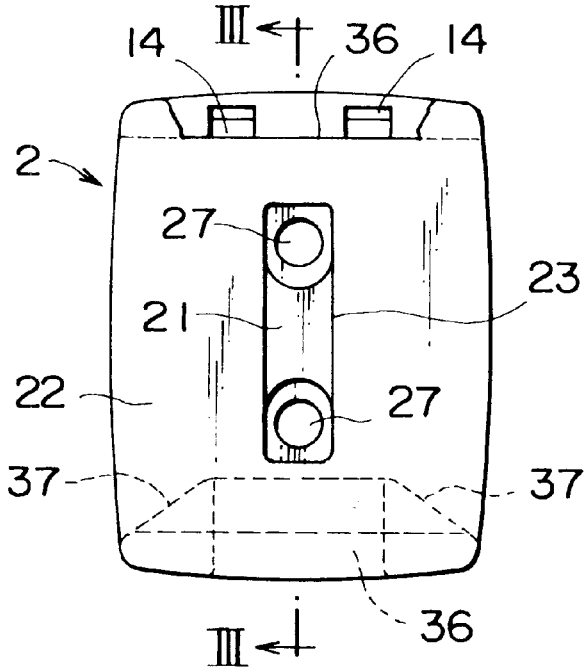
FIG. 2 is a front view of a slider of the waist adjusting device of FIG. 1.
Figure 3:
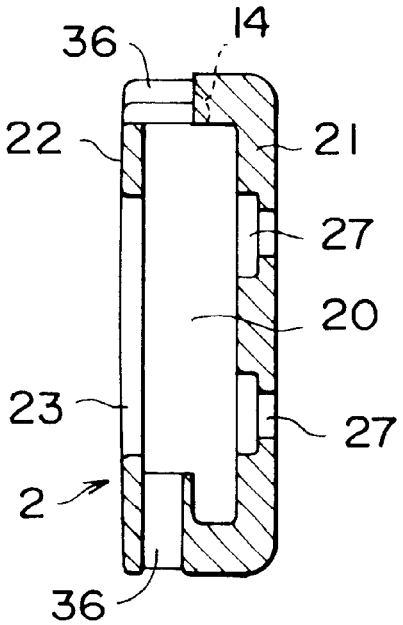
FIG. 3 is a sectional view taken along the line III—III in FIG. 2 of the waist adjusting device.

As shown in FIGS. 1 to 3, the slider body 2 of the waist adjusting device is rectangular while both right and left side walls are open and have a hollow through portion 20 through which the adjusting belt 1 is inserted. Then, an insertion hole 36 is provided in upper and lower portions of the slider 2 respectively to be perpendicular to this through portion 20 such that the operating piece 7 is capable of being inserted vertically. The insertion holes 36 are provided at a position deviated to a rear plate 22 of the slider body 2 as shown in FIG. 3 and the adjusting belt 1 is inserted on the side of a surface plate 21. A front portion of an entrance of the insertion hole 36 located at a top of the slider falls with respect to the surrounding while both side faces are tapered. Notch portions 14 are provided in a back wall face, so that the operating piece 7 can be inserted into the upper insertion hole 36 easily without a collision of engaging protrusions 72, which will be described later, of the operating piece 7 with the wall face. A slope portion 37, which is inclined downward outward, is provided on each of both sides of the lower through hole 36 so that elastic leg portions 73 of the operating piece 7 make sliding contact and slide.

A rectangular through hole 23 is provided vertically in the center of the rear plate 22 of the slider body 2. Two attaching holes 27 having a T-shaped section or tapered section such that an inside thereof is expanded are provided vertically in the surface plate 21 within a range of the through hole 23 while opposing the through hole 23 in order to mount the fixing device 4. Therefore, the through hole 23 in the rear plate 22 is provided for forming the attaching holes 27 to be provided on a rear side of the surface plate 21 and provided for convenience for pressing work to crush an attaching post 42 of the fixing device 4 inserted into the attaching hole 27.

Figure 4:
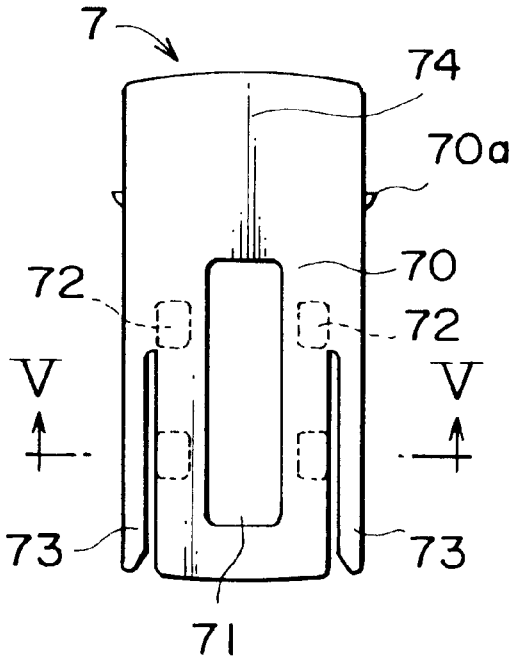
FIG. 4 is a front view of an operating piece of the waist adjusting device of FIG. 1.
Figure 5:
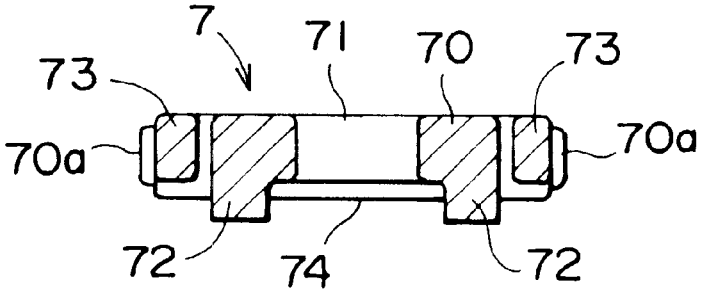
FIG. 5 is an enlarged sectional view taken along the line V—V in FIG. 4 of the operating piece of the waist adjusting device.

The operating piece 7 to be inserted into the slider body 2 is as large as can be inserted into the insertion hole 36 in the slider body 2 as shown in FIGS. 1, 4 and 5. A through hole 71 coinciding with the through hole 23 of the slider body 2 is provided vertically in the center of a main body 70 of the operating piece 7. A face of the operating piece 7 or a surface opposing the rear plate 22 of the slider body 2 is flat. The face opposing the surface plate 21 is formed thick such that an operating portion 74 is protruded from the main body 70. Two engaging protrusions 72 capable of engaging the adjusting protrusions 11 disposed on the adjusting belt 1 are provided vertically on both sides of the through hole 71 of the main body 70.

The elastic leg portions 73 having an elasticity are integrally disposed on both sides of the operating piece 7. The elastic leg portions 73 have the same thickness as the main body 70 and are provided in substantially the same length as the main body 70 from the central portion of the main body 70 up to an end portion thereof such that they are parallel to the main body 70. An end portion of each of the elastic leg portions 73 is tapered with an inside face thereof inclined so that it is capable of sliding on the slope portion 37 provided on the slider body 2. Further, a triangular small protrusion 70*a* is provided on each of both sides of the operating portion 74 of the operating piece 7 so as to prevent the operating piece 7 from slipping out upward of the insertion hole 36 when the operating piece 7 is inserted into the insertion hole 36. As a result, the small protrusions 70*a* collide with edge portions of the upper insertion hole 36.

The fixing device 4 for attaching the slider body 2 to the waist belt 6 has two attaching posts 42 each having a tapered end which are provided vertically on a rear face of a cap 41 at an interval corresponding to the attaching holes 27 provided vertically on the surface plate 21 of the slider body 2 as shown in FIG. 1. The attaching posts 42 are pierced into the waist belt 6 and inserted into the attaching holes 27. After that, the ends thereof are crushed by heating with pressure within each of the attaching holes 27 and fixed. Meanwhile, it is permissible to only crush the end with pressure within the attaching hole 27 to fix each of the attaching posts 42 without heating the end of the attaching post 42.

Upon attachment of the waist adjusting device, as shown in FIGS. 7 to 9, the slider body 2 is attached to the rear face at the end of the outside waist belt 6 of beltless trousers, skirt or the like. As described above, the attaching post 42 of the fixing device 4 are pierced from the surface of the waist belt 6 and inserted into the attaching holes 27 provided in the surface plate 21 of the slider body 2. Then, by crushing the ends thereof by heating with pressure, the slider body 2 is attached to the waist belt 6. Then, the adjusting belt 1 is inserted into the attached slider body 2, or in case where the adjusting belt 1 is attached on the rear face of the narrow foundation 12, the adjusting belt 1 and narrow foundation 12 are inserted into the slider body 2. Both ends of the adjusting belt 1 or narrow foundation 12 are sewed to the inside waist belt 6 such that a gap is generated at an intermediate portion of the adjusting belt 1.

Next, the main body 70 and elastic leg portions 73 of the operating piece 7 are inserted through the upper insertion hole 36 of the slider body 2 and by pressing the operating portion 74 strongly, the small protrusions 70*a* on both sides are passed through the upper insertion hole 36. Consequently, as shown in FIG. 6, the ends of the elastic leg portions 73 are brought into contact with the slope portions 37 provided on both sides of the lower through hole 36 so that they are held with the ends thereof slightly open, that is, in a condition providing elastic urging force. As a result, the operating piece 7 is urged upward, so that the adjusting protrusions 11 engage with the engaging protrusions 72.

Upon adjusting of the waist adjusting device attached to the waist belt 6, by pressing the operating portion 74 of the operating piece 7 inserted into the slider body 2, the ends of the elastic leg portions 73 slide while opening along the slope portions 37 against the elasticity of the elastic leg portions 73. When the operating piece 7 is pressed down, the engagement between the adjusting protrusion 11 of the adjusting belt 1 and the engaging protrusion 72 of the operating piece 7 is released. With the operating piece 7 pressed, the slider body 2 is slid to the right and left so as to adjust the length of the waist. And after that, when the pressing of the operating piece 7 is released, the operating piece 7 is restored upward by an elasticity of the elastic leg portions 73 until the small protrusions 70*a* make contact with the edge portion of the upper insertion hole 36. Then, the adjusting protrusions 11 engage with the engaging protrusions 72 so as to complete the adjustment of the length of the waist.

Figure 10:
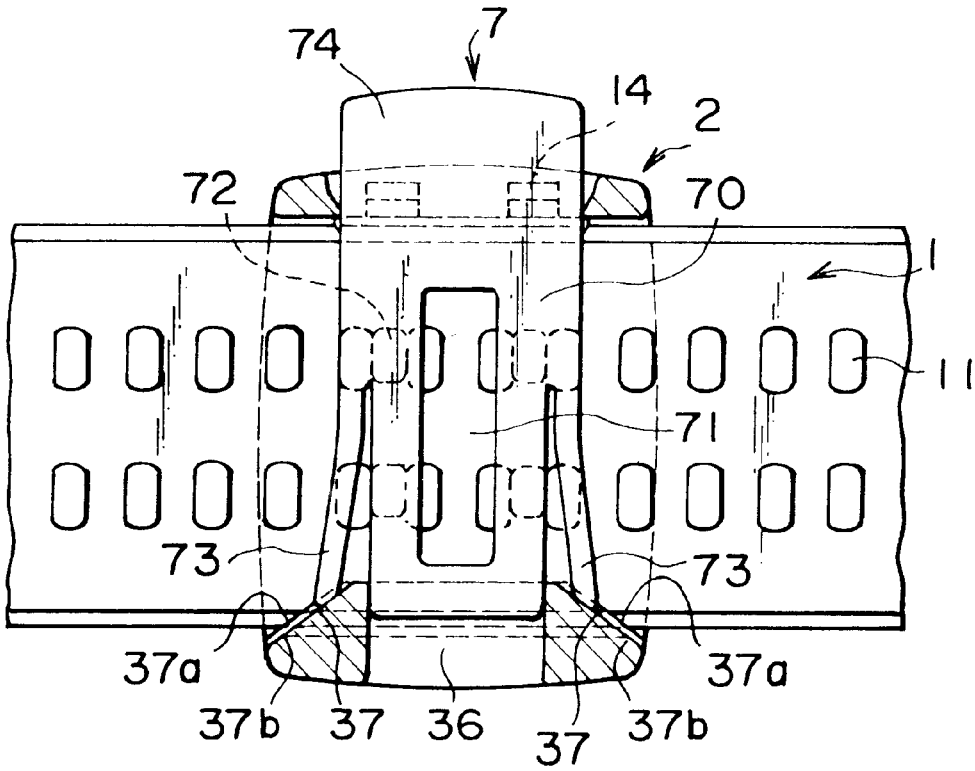
FIG. 10 is a sectional view of main portions of the waist adjusting device according to a second embodiment of the present invention.
Figure 11:
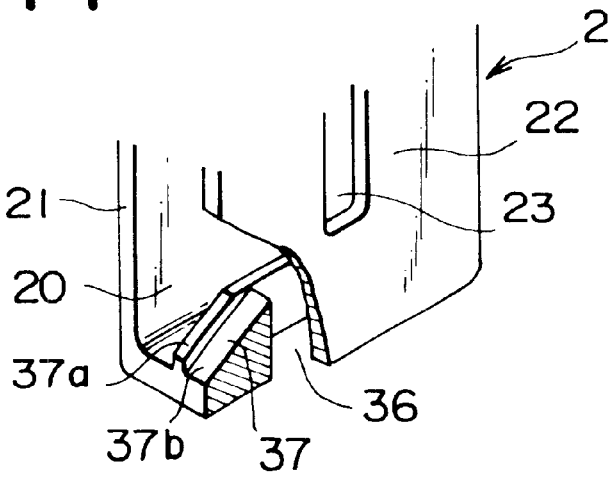
FIG. 11 is a partially broken perspective view of a slider body of the waist adjusting device of FIG. 10.

In the waist adjusting device of a second embodiment of the present invention shown in FIGS. 10 and 11, the slope portions 37 provided on both sides of the lower insertion hole 36 in the slider body 2 in the waist adjusting device of the first embodiment are improved. According to this embodiment, a side wall 37*a* which is a small protrusion is provided so as to protrude near the surface plate 21 on each of the slope portions 37 disposed on both sides of the lower insertion hole 36 in the slider body 2. Consequently, a concave groove 37*b* is formed so that the sectional shape of the slope portion 37 is a concave. Then, the end of the elastic leg portion 73 provided in the operating piece 7 makes sliding contact with this concave groove 37*b* and slides, so that the elastic leg portions 73 are prevented from slipping out of the slope portions 37. Further, the leg portions 73 never deviate so as to ensure a smooth sliding in a stabilized condition.

Figure 12:
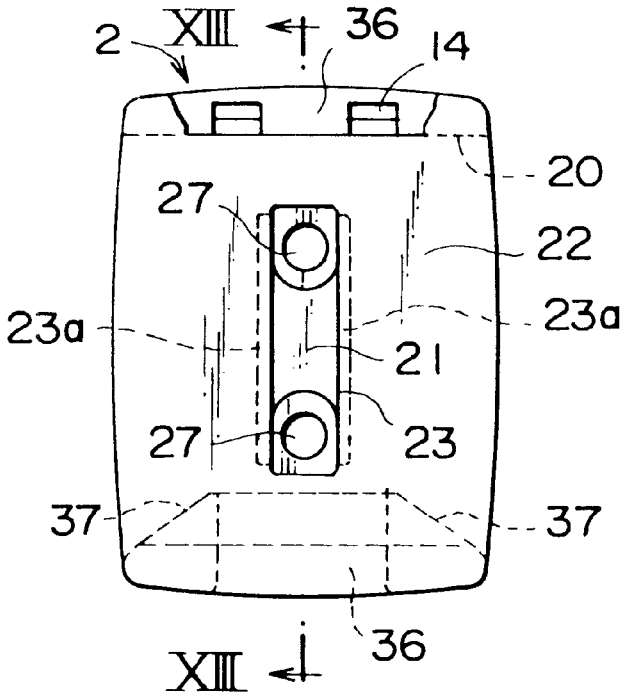
FIG. 12 is a front view of the slider of the waist adjusting device according to a third embodiment of the present invention.
Figure 13:
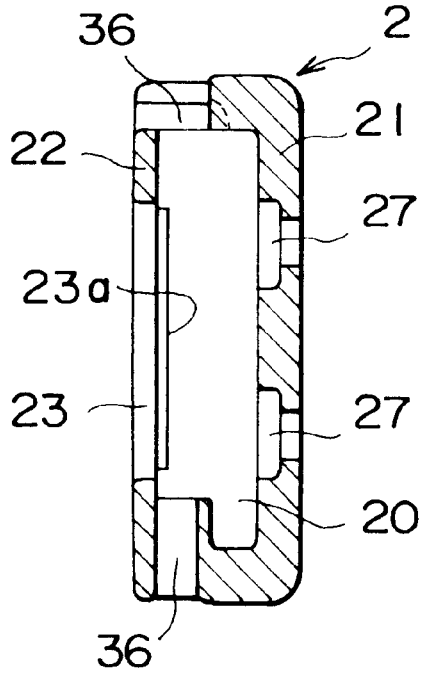
FIG. 13 is a sectional view taken along the line XIII—XIII in FIG. 12 of the slider of the waist adjusting device.
Figure 14:
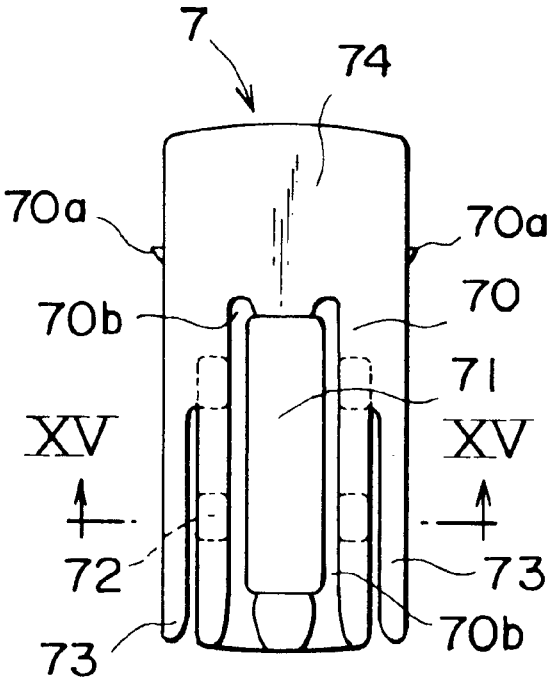
FIG. 14 is a front view of the operating piece of the waist adjusting device of the third embodiment.
Figure 15:
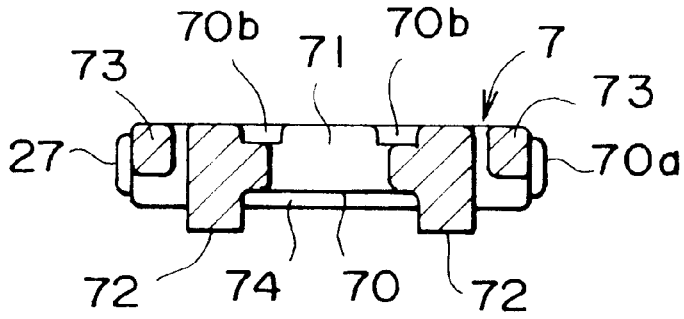
FIG. 15 is an enlarged sectional view taken along the line XV—XV in FIG. 14 of the operating piece of the waist adjusting device.

In the waist adjusting device according to a third embodiment of the present invention shown in FIGS. 12 to 17, the slider body 2 and operating piece 7 of the waist adjusting device of the first embodiment are improved. A protruded ridge 23*a* having a convex cross section is provided along an entire edge portion of each of both sides on an inside face or rear face of the rectangular through hole 23 provided vertically in the center of the rear plate 22 as shown in FIGS. 12 and 13. Further, as shown in FIGS. 14 and 15, a long groove 70*b* having a concave cross section and extending up to the bottom end of the main body 70 is provided on each of both sides of the rectangular through hole 71 provided vertically in the center of the main body 70. The long grooves 70*b* are provided on the surface opposing the rear plate 22 of the slider body 2 so that the protruded ridges 23*a* of the slider body 2 engage with the long groove 70*b* of the operating piece 7.

The elastic leg portions 73 having an elasticity disposed on both sides of the main body 70 of the operating piece 7 are formed such that a surface thereof opposing the rear face plate 22 of the slider body 2 is flush with the surface of the main body 70. The surface of the elastic leg portions 73 on a side having the engaging protrusions 72 is formed so as to fall further with respect to the surface of the main body 70. As a result, the operating piece 7 is formed entirely in a thin structure.

Figure 16:
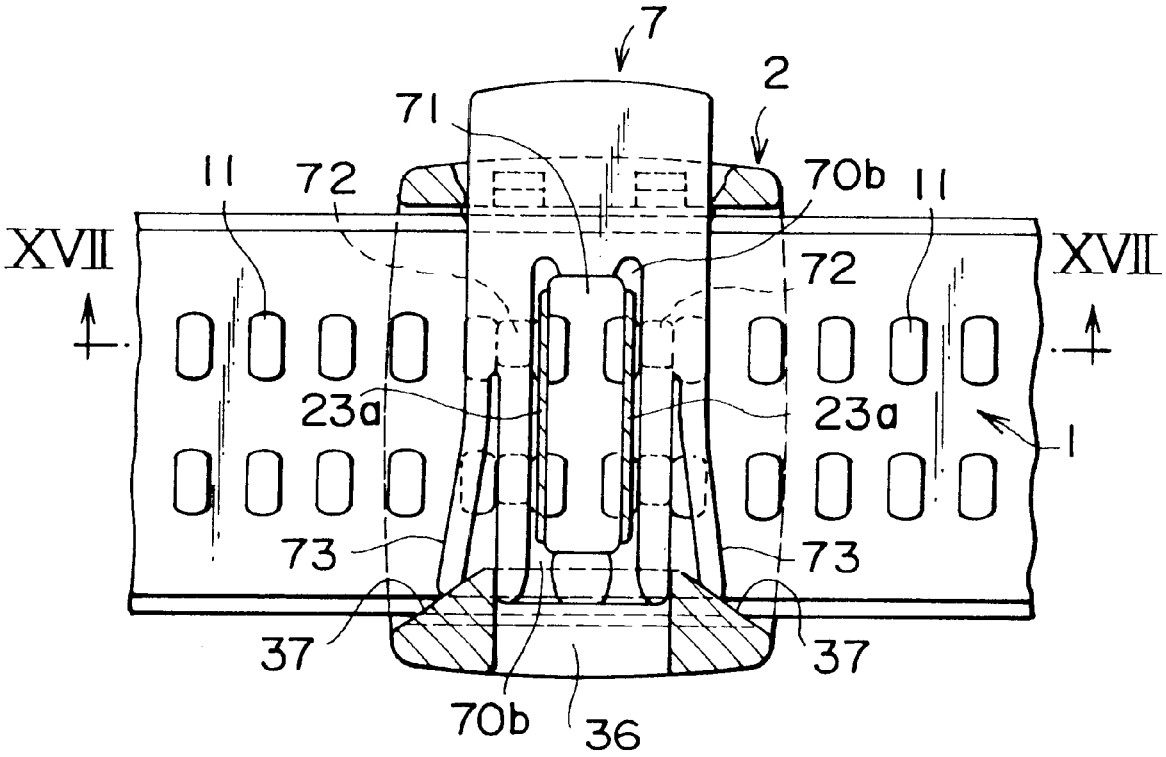
FIG. 16 is a sectional view taken along the line XVI—XVI in FIG. 17 of the waist adjusting device.
Figure 17:
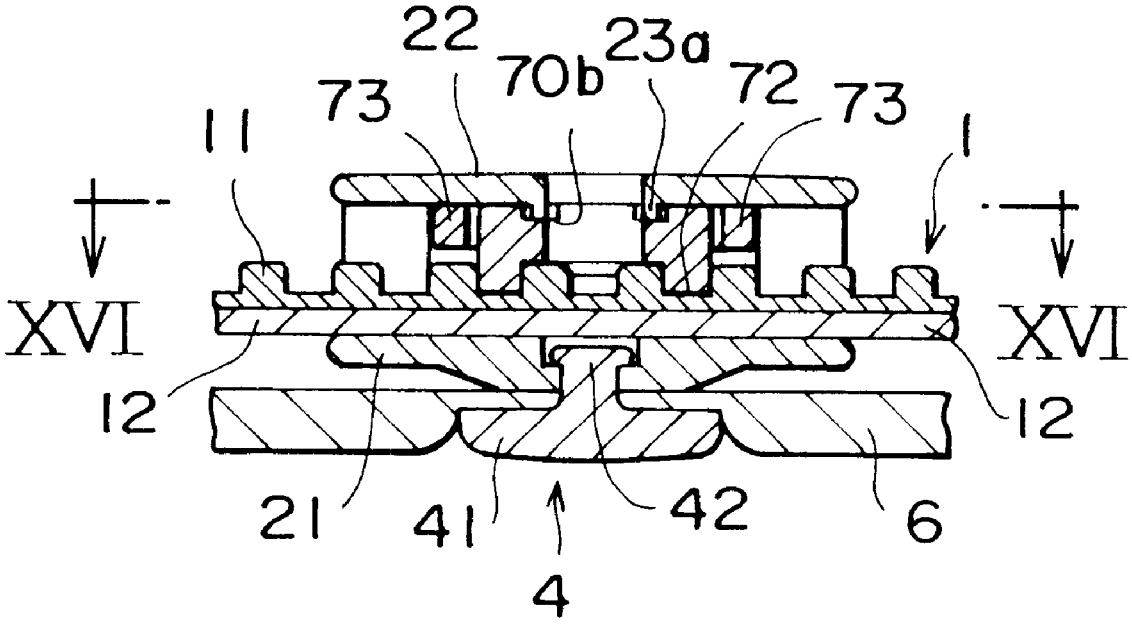
FIG. 17 is a sectional view taken along the line XVII—XVII in FIG. 16 of the waist adjusting device.

The waist adjusting device of the third embodiment in use will be described. First, as shown in FIGS. 16 and 17, the main body 70 and elastic leg portions 73 of the operating piece 7 are inserted through the insertion hole 36 of the slider body 2 by pressing the operating portion 74. At this time, the protruded ridges 23*a* provided on the slider body 2 are engaged with the long grooves 70*b* provided in the operating piece 7. At the same time when part of the main body 70 is inserted into the lower insertion hole 36, the ends of the elastic leg portions 73 are brought into the sliding contact with the slope portions 37 and slid thereon. By passing the small protrusions 70*a* provided on the operating portion 74 through the upper insertion hole 36, the small protrusions 70*a* collide with the edge portion of the upper insertion hole 36. At this time, because the elastic leg portion 73 is thin, a gap is generated between the adjusting protrusion 11 of the adjusting belt 1 as shown in FIG. 17. Consequently, the elastic leg portions 73 do not collide with the adjusting protrusions 11 so that an operation of the elastic leg portions 73 can be carried out smoothly.

Figure 18:
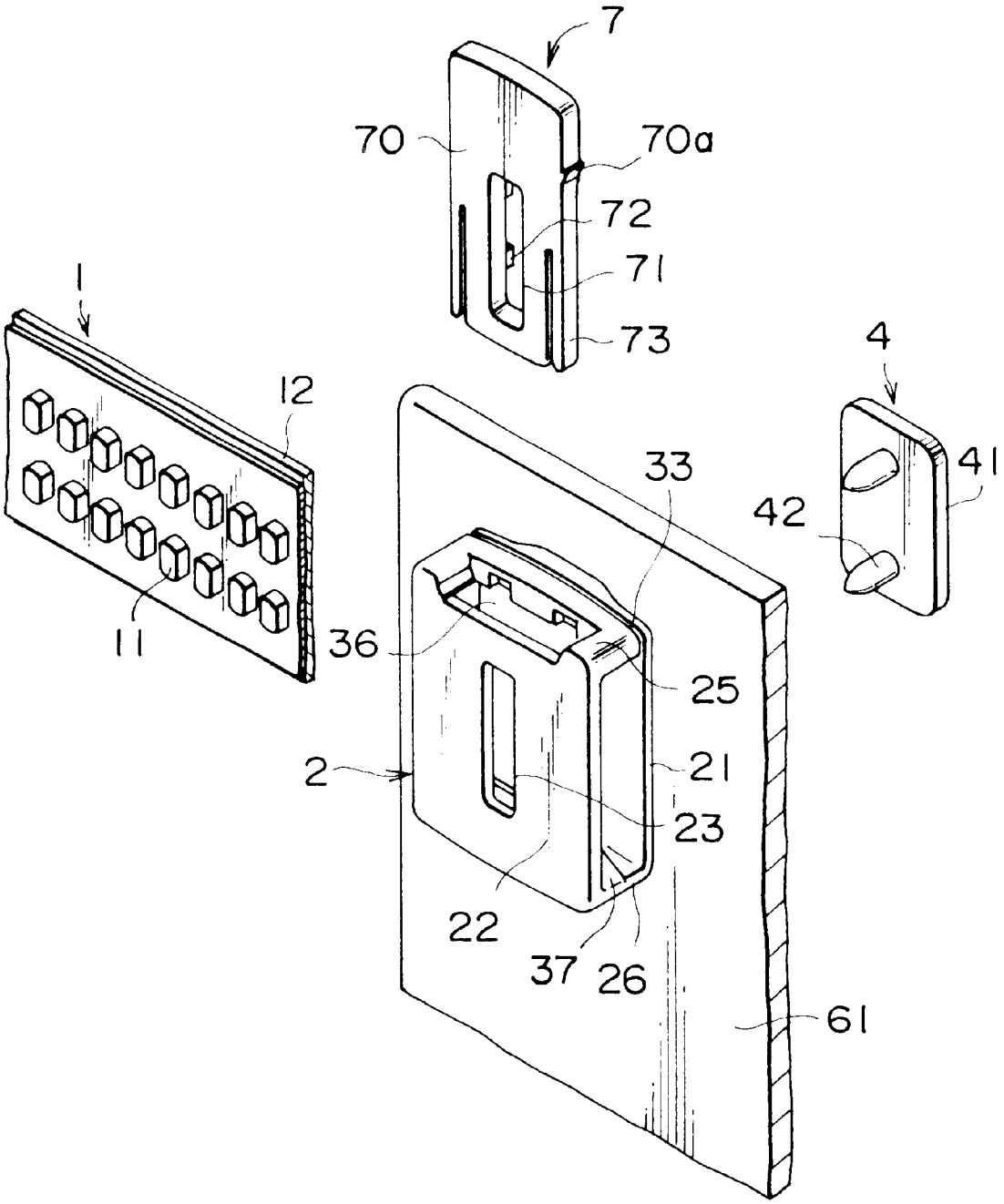
FIG. 18 is an exploded perspective view of the waist adjusting device according to a fourth embodiment of the present invention.
Figure 19:
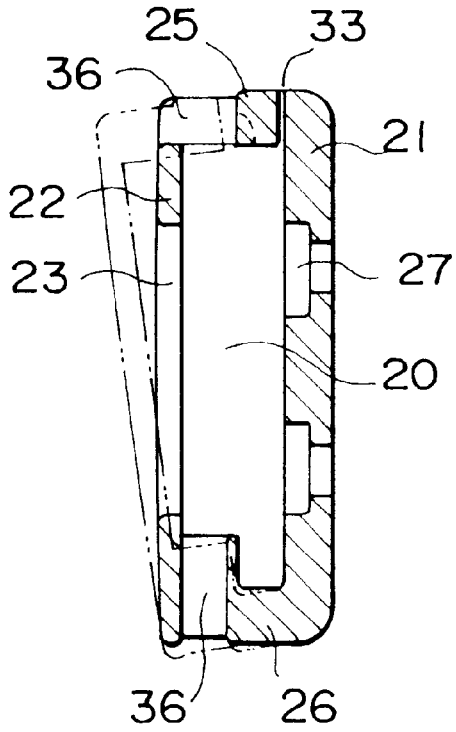
FIG. 19 is a sectional view of the slider body of the waist adjusting device.
Figure 20:
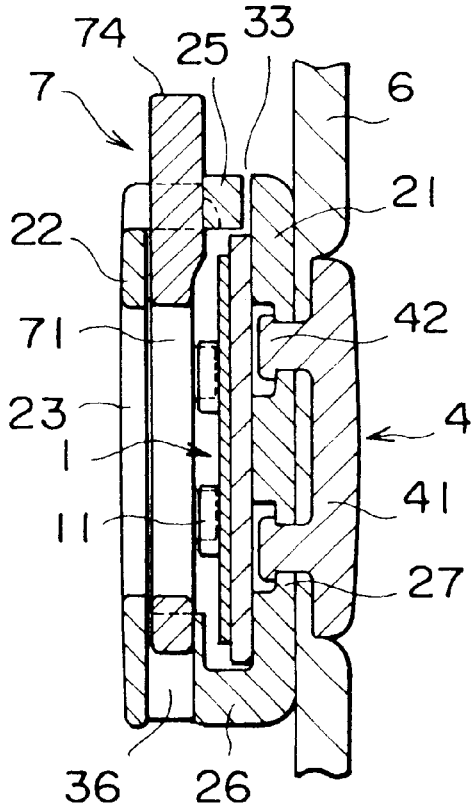
FIG. 20 is a sectional view of the waist adjusting device of the fourth embodiment.

FIGS. 18 to 20 show the waist adjusting device according to a fourth embodiment of the present invention. This waist adjusting device is composed of the adjusting belt 1, slider body 2, operating piece 7 and fixing device 4. The adjusting belt 1 and fixing device 4 have the same structure as the first embodiment. The slider body 2 is entirely rectangular, and the surface plate 21 and the rear plate 22 are connected by a bottom plate 26 so that the through portion 20 is formed in the right/left direction between the surface plate 21 and the rear plate 22 such that the adjusting belt 1 is capable of passing therethrough. A top plate 25 is separate from the surface plate 21 via a gap portion 33 and as shown by two-dot and dash line of FIG. 19, the bottom plate 26 is elastically deformed so that the surface plate 21 departs from the rear plate 22 and the gap portion 33 can be enlarged.

The insertion hole 36 is provided in each of the top plate 25 and the bottom plate 26 of the slider body 2 such that the operating piece 7 is capable of passing therethrough. The insertion hole 36 is disposed at a position deviated to the rear plate 22 of the slider body 2 as shown in FIGS. 19 and the adjusting belt 1 passes on the side near the surface plate 21. A front portion of an entrance of the upper insertion hole 36 falls with respect to the surrounding and both sides thereof are tapered. The notch portions 14 are provided in the back wall face of the upper insertion hole 36 so that the operating piece 7 can be inserted through the upper insertion hole 36 easily without a trouble of collision of the engaging protrusions 72 of the operating piece 7 with the wall face. Then, the slope portions 37, which are inclined downward outward are provided on both sides of the lower insertion hole 36, so that the elastic leg portions 73 of the operating piece 7 make sliding contact with the slope portions 37 and can slide.

The rectangular through hole 23 is provided vertically in the center of the rear plate 22 of the slider body 2. The two attaching holes 27 having a T-shaped cross section or a tapered section whose inner portion is expanded are provided vertically in the surface plate 21 opposing this through hole 23. Therefore, the through hole 23 in the rear plate 22 is provided for forming the attaching holes 27 to be provided on a rear face of the surface plate 21 and providing convenience for pressing work to crush the attaching posts 42 of the fixing device 4 inserted into the attaching holes 27.

Upon attachment of the waist adjusting device, first, the main body 70 and the elastic leg portions 73 of the operating piece 7 are inserted through the upper insertion hole 36 and set in the slider body 2. Then, the slider body 2 is attached to the rear face of each end of the outside waist belt 6 of beltless trousers, skirt or the like and at this time, the attaching posts 42 of the fixing device 4 are pierced from the surface of the waist belt 6 and inserted into the attaching holes 27 provided in the surface plate 21 of the slider body 2. Then, by crushing ends thereof by heating with pressure, the slider body 2 is attached to the waist belt 6. Further, both ends of the adjusting belt 1 are sewed to the waist belt 6 together with the narrow foundation 12 and fixed thereto such that a gap is generated at the intermediate portion of the adjusting belt 1. Then, the slider body 2 attached to the waist belt 6 is opened utilizing the gap portion 33 and mounted on the adjusting belt 1 utilizing the gap at the intermediate of the adjusting belt 1 and the narrow foundation 12, whose both ends are fixed. Then, the slider body 2 is set up so that the adjusting belt 1 is fitted in the slider body 2 by pressing. Further, it is permissible to so construct that the slider body 2 is mounted on the adjusting belt 1 after the operating piece 7 is fitted in the slider body 2.

The slider body 2 is attached to the outside waist belt 6 of the beltless trousers by means of the fixing device 4 and the attached slider body 2 is opened at the gap portion 33. Then, the slider body 2 is mounted on the adjusting belt 1 whose both ends are fixed to the inside waist belt 6. Then, the main body 70 and the elastic leg portions 73 of the operating piece 7 are inserted through the upper insertion hole 36 of the slider body 2 and then, the elastic leg portions 73 are brought into a sliding contact with the slope portions 37 so as to urge the operating piece 7 upward.

Upon adjustment of the waist adjusting device attached to the waist belt 6, as shown in FIG. 20, by pressing the operating portion 74 of the operating piece 7 inserted into the slider body 2, ends of the elastic leg portions 37 slide on the slope portions 37 resisting an elastic force of the elastic leg portions 73. By pressing down the operating piece 7 further, the engagement between the adjusting protrusions 11 of the adjusting belt 1 and the engaging protrusions 72 of the operating piece 7 is released. With the operating piece 7 pressed, the slider body 2 is slid to the right and left so as to adjust the length of the waist. After that, when the pressing on the operating piece 7 is released, the operating piece 7 is restored upward by the elastic force of the elastic leg portions 73 until the small protrusions 70*a* comes into contact with the edge portion of the upper insertion hole 36. Then, the adjusting protrusions 11 are engaged with the engaging protrusions 72 so as to adjust the length of the waist.

FIGS. 21 to 30 show the waist adjusting device of the sixth embodiment of the present invention. The waist adjusting device is composed of the slider body 2 which is divided to the surface plate 21 and the rear plate 22, fixing device 4, operating piece 7, and adjusting belt 1. These components are formed by injection molding or extrusion molding using thermoplastic resin such as polyamide, polyacetal, polypropylene, polybutylene terephthalate and have elasticity.

Figure 22:
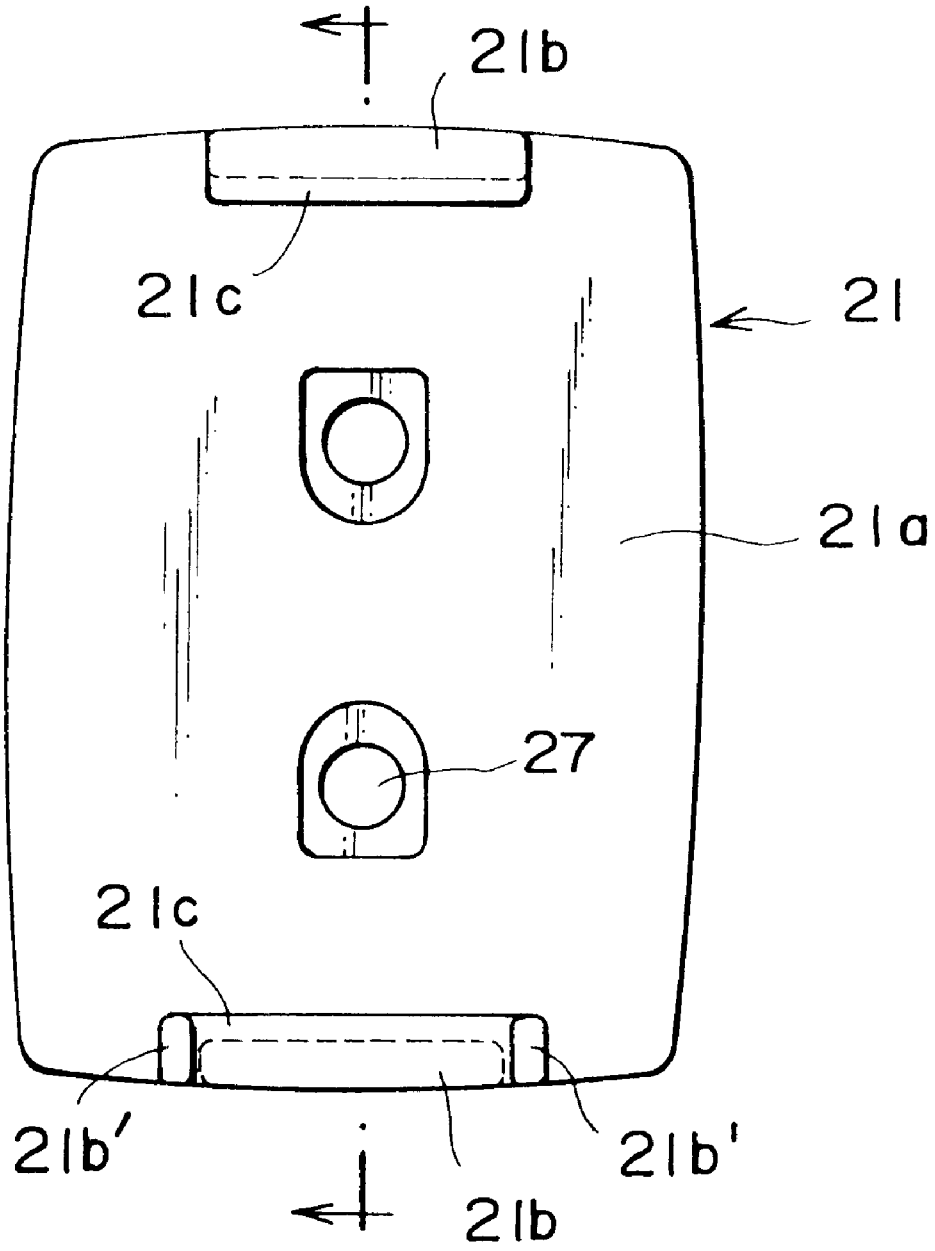
FIG. 22 is a front view of a surface plate of the waist adjusting device of the fifth embodiment.
Figure 23:
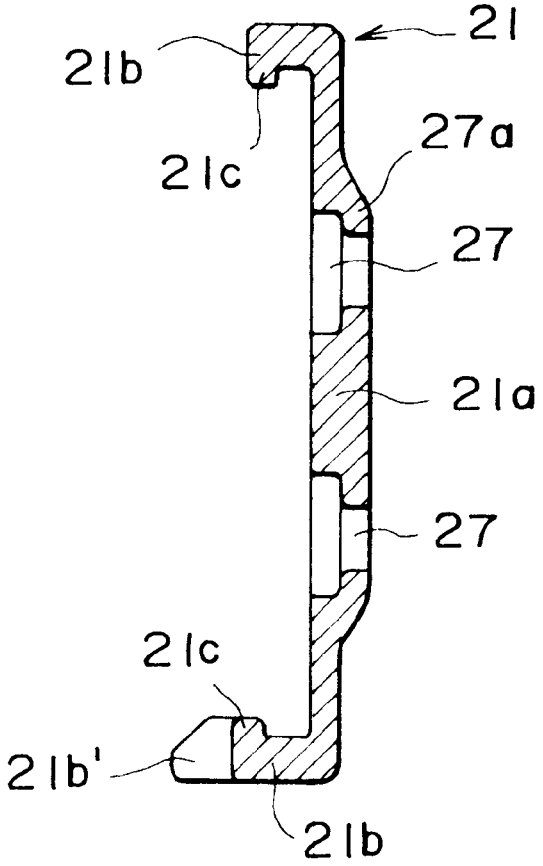
FIG. 23 is a sectional view taken along the line XXIII—XXIII in FIG. 22 of the surface plate.
Figure 24:
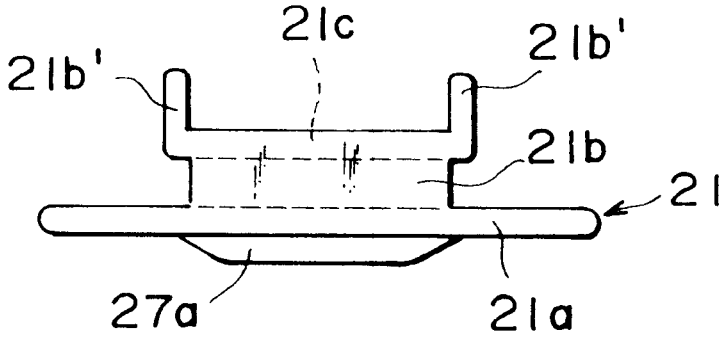
FIG. 24 is a bottom view of the surface plate.
Figure 25:
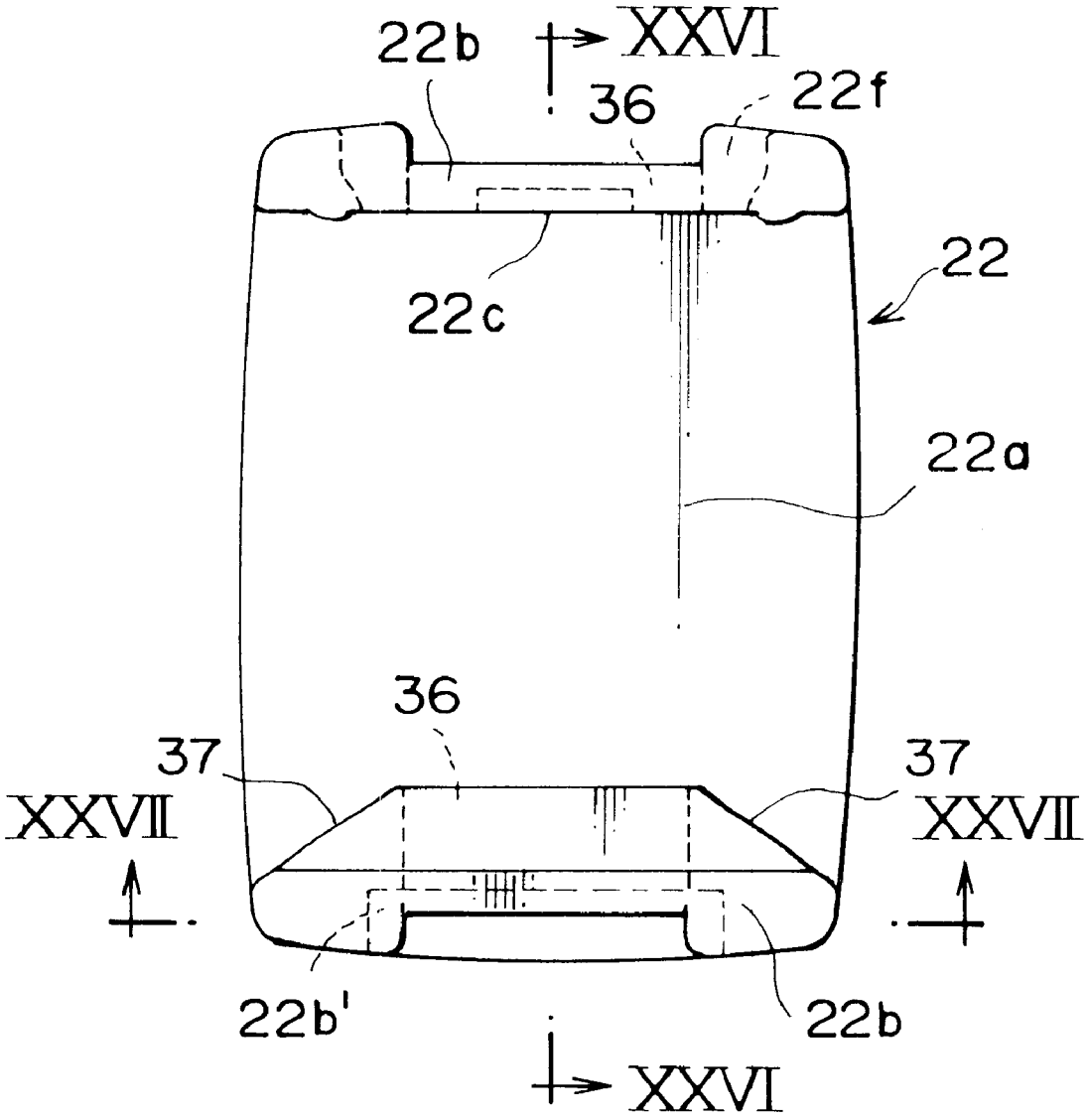
FIG. 25 is a front view of a rear plate of the waist adjusting device of the fifth embodiment.
Figure 26:
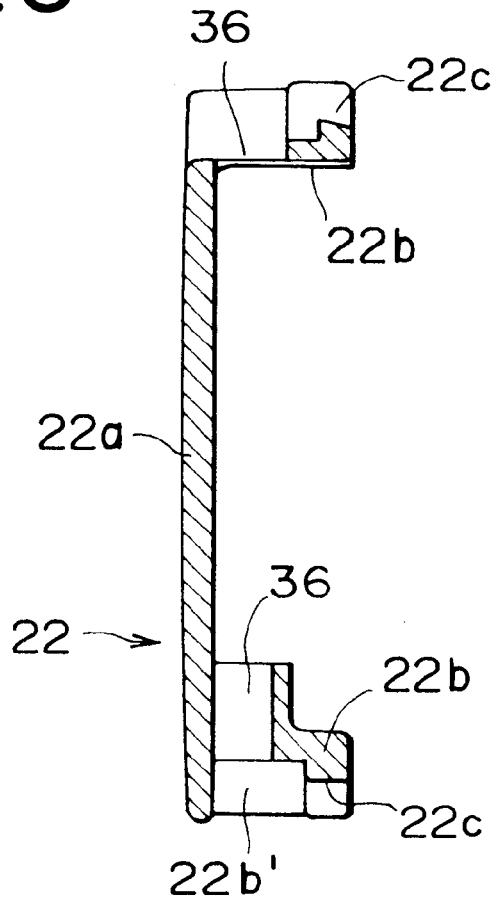
FIG. 26 is a sectional view taken along the line XXVI—XXVI in FIG. 25 of the rear plate.
Figure 27:
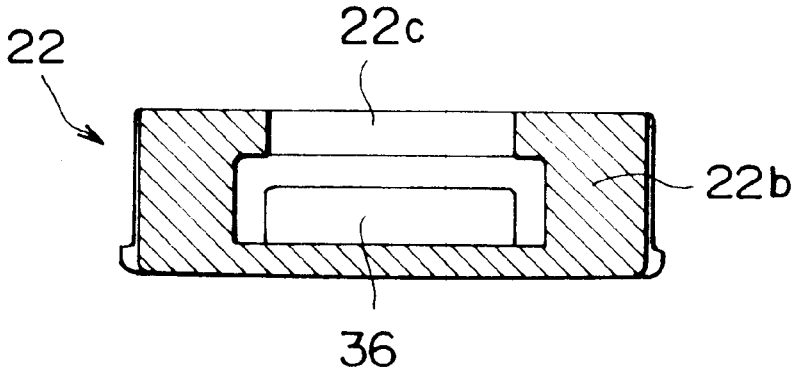
FIG. 27 is a sectional view taken along the line XXVII—XXVII in FIG. 26 of the rear plate.
Figure 28:
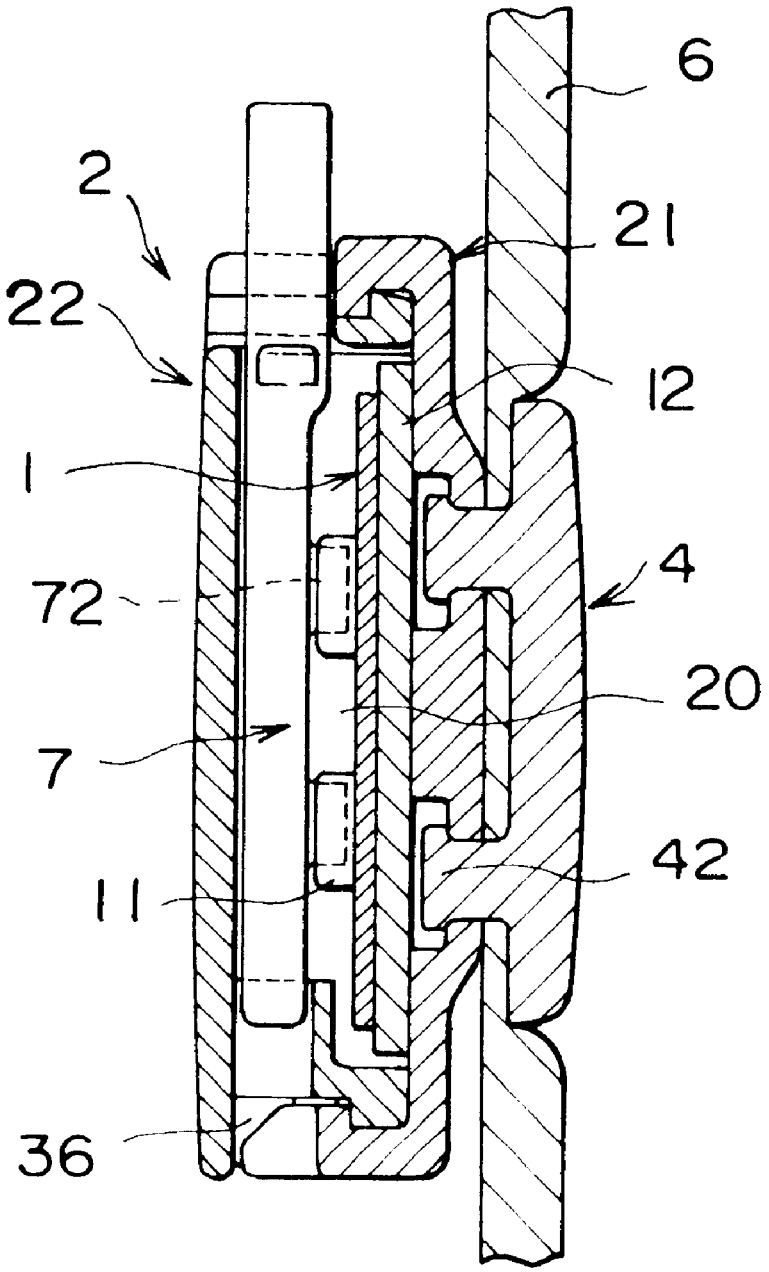
FIG. 28 is a longitudinal sectional view of the waist adjusting device of the fifth embodiment.

As shown in FIGS. 22 to 24, the surface plate 21 composing the slider body 2 has fitting pieces 21*b* protruded at right angle from upper and lower end portions of a plate-like main body 21*a*. An inward directed hook-shaped fitting portion 21*c* is provided at each end of this fitting piece 21*b* and capable of engaging with an engaging portion 22*c* provided on the rear plate 22. Then, protruding pieces 21*b*' are provided on both sides of the lower fitting piece 21*b* and engage with recesses 22*b*' provided in the engaging piece 22*b*. Two attaching holes 27 having a T-shaped section or a tapered section are provided vertically in the center of the main body 21*a* and a surrounding of the attaching hole 27 is formed in a thick portion 27*a* so as to receive the attaching posts 42 of the fixing device 4.

As shown in FIGS. 25 to 30, the rear plate 22 of the slider body 2 has engaging pieces 22*b* protruded at right angle from the upper and lower end portions of a plate-like main body 22*a*. A through hole 36 is provided in the center of this engaging piece 22*b* vertically, in which the operating piece 7 is inserted. The outward directed hook-shaped engaging portion 22*c* is provided at an end of the engaging piece 22*b* and engages with the fitting portion 21*c* provided on the fitting piece 21*b* of the surface plate 21. Then, slope portions 37 formed of slopes inclined downward are provided on both sides of the insertion hole 36 provided in the lower engaging piece 22*b*, so that the elastic leg portions 73 of the operating piece 7 make sliding contact with the slope portions 37. Further, the recesses 22*b*' are provided in a bottom face of the engaging piece 22*b* so that the surrounding portion of the insertion hole 36 is dented and the protruding piece 21*b*' of the fitting pieces 21*b* are accommodated therein. Notch portions 22*f* are provided by cutting out both sides of the insertion hole 36 in the engaging portion 22*c* provided in the upper engaging piece 22*b* so as to facilitate an insertion of the operating piece 7 having the engaging protrusions 72.

The disposition of the fitting piece 21*b* and the engaging piece 22*b* is not restricted to the above described embodiment and it is permissible to provide the rear plate 22 with the fitting piece 21*b* and the surface plate 21 with the engaging piece 22*b*. Alternatively it is also permissible to provide an upper portion of any one of the surface plate 21 and the rear plate 22 with the fitting piece 21*b* and the other one with the engaging piece 22*b*, while a lower portion thereof is provided with the fitting piece 21*b* and the engaging piece 22*b* in the same manner respectively. Further, the number of the fitting pieces 21*b* and the engaging pieces 22*b* is not restricted to one vertical pair, and they may be provided each in multiple quantities. In this case, the operating piece 7 has the same structure as the first embodiment.

Figure 21:
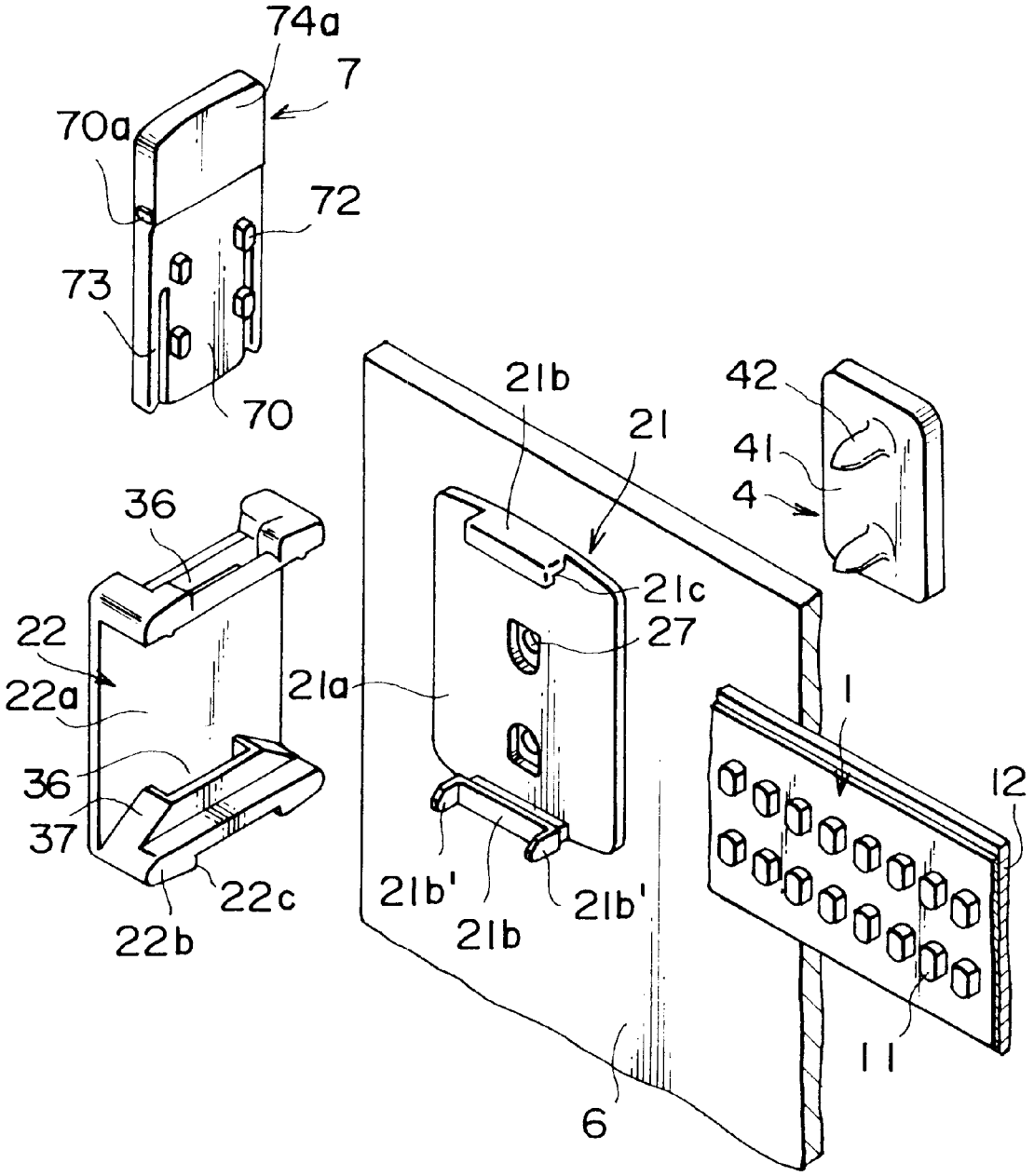
FIG. 21 is an exploded perspective view of the waist adjusting device according to a fifth embodiment of the present invention.

As shown in FIG. 21, the fixing device 4 has two attaching posts 42 provided vertically on a rear face of a rectangular cap 41, whose end is sharp pointed. The attaching posts 42 are inserted into the attaching holes 27 provided in the main body 21*a* of the surface plate 21 and then, the ends thereof are crushed so as to fix the surface plate 21 to the waist belt 6. The adjusting belt 1 is a long belt as shown in FIG. 21 and has two rows of the adjusting protrusions 11 at a predetermined interval on the surface of the belt. These adjusting protrusions 11 engage with the engaging protrusions 72 of the operating piece 7. The narrow foundation 12 of a common cloth with the waist belt 6 is mounted on the rear face of the adjusting belt 1.

Figure 29:
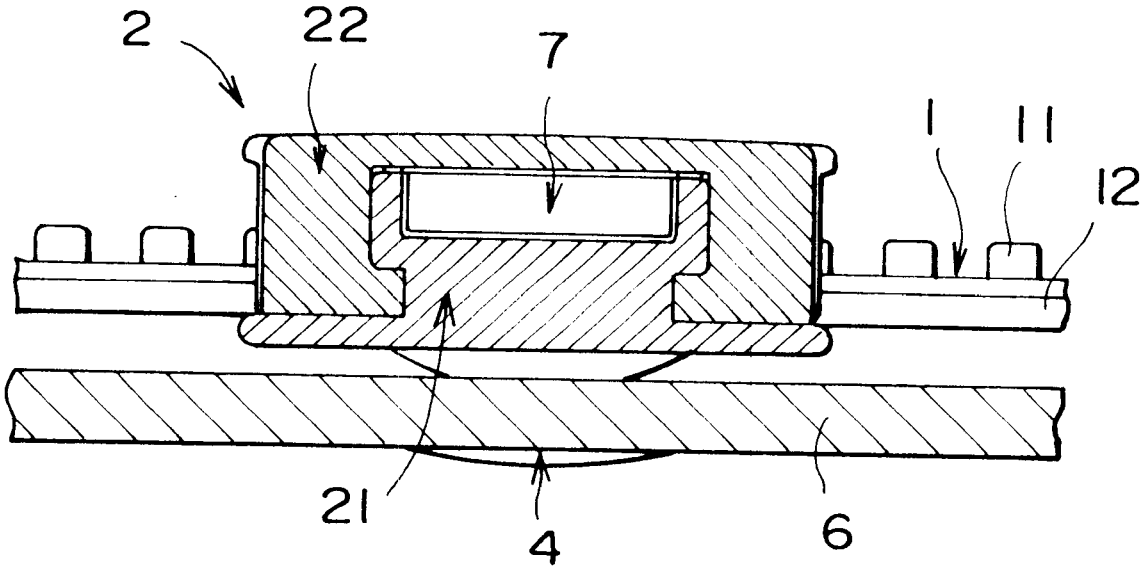
FIG. 29 is a sectional view of the waist adjusting device of the fifth embodiment.
Figure 30:
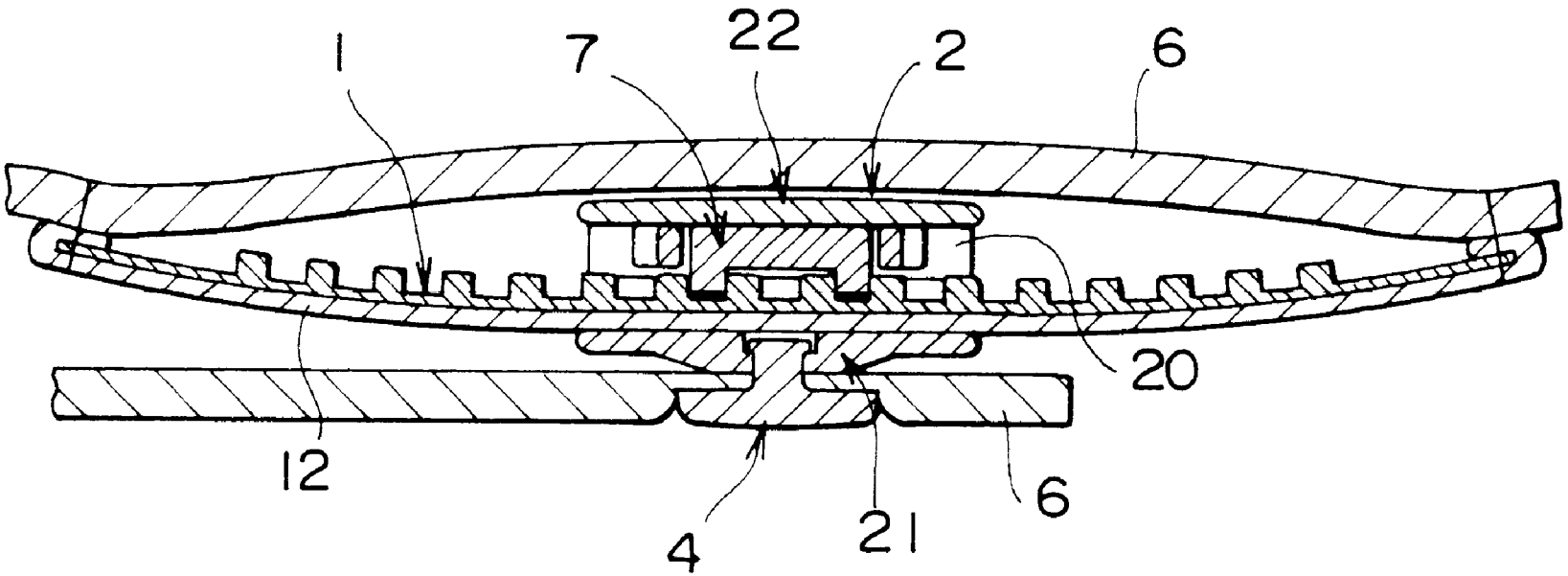
FIG. 30 is a cross sectional view showing an attaching state of the waist adjusting device of the fifth embodiment.
Figure 31:
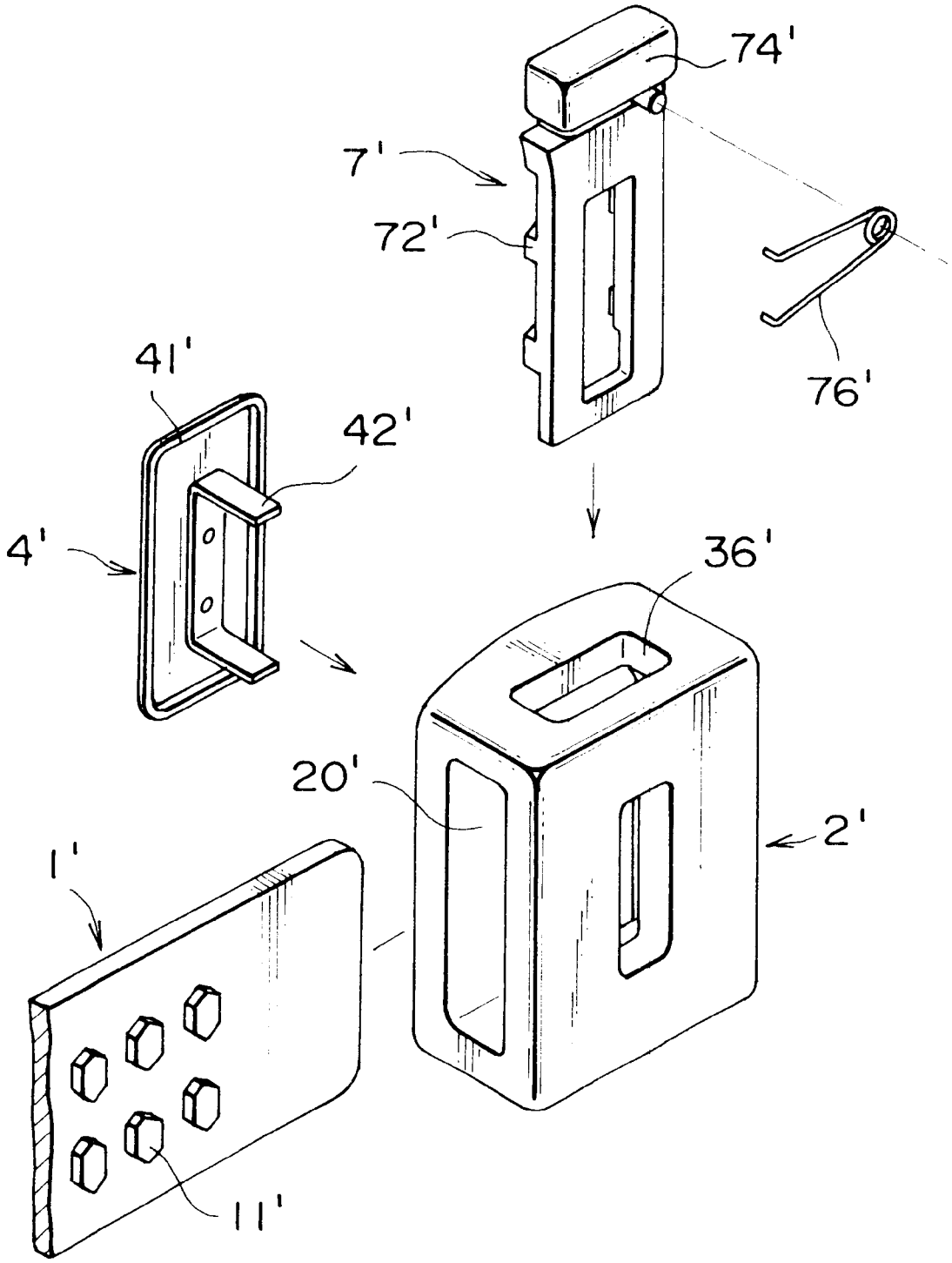
FIG. 31 (Prior Art)
FIG. 31 is an exploded perspective view of a well known waist adjusting device.

This waist adjusting device in use will be described. When the slider body 2 is attached to the rear face of the waist belt 6 of beltless trousers or the like as shown in FIGS. 29 and 30, first of all, the attaching posts 42 of the fixing device 4 are pierced from the surface of the waist belt 6, and the attaching posts 42 are fitted to the attaching holes 27 provided in the main body 21*a* of the surface plate 21. By crushing ends of the attaching posts 42 by heating with pressure or cooling with pressure, the surface plate 21 is attached to the waist belt 6. Both ends of the adjusting belt 1 are attached to the waist belt 6 together with the narrow foundation 12 and the adjusting belt 1 is disposed on the surface of the surface plate 21. After that, the operating piece 7 is inserted and set in the insertion hole 36 of the rear plate 22 and then, the rear plate 22 is placed between the waist belt 6 and the adjusting belt 1. Then, the upper and lower engaging portions 22*c* of the rear plate 22 are engaged with the upper and lower fitting portions 21*c* of the surface plate 21 so as to assemble the slider body 2. Consequently, the through portion 20 through which the adjusting belt 1 is capable of passing freely is formed between the surface plate 21 and the rear plate 22.

Upon adjustment of the waist adjusting device, when the operating piece 7 set in the slider body 2 is pressed, the ends of the elastic leg portions 73 slide on the slope portions 37 so that the operating piece 7 lowers, thereby releasing the engagement between the adjusting protrusions 11 of the adjusting belt 1 and the engaging protrusions 72 of the operating piece 7. With the operating piece 7 pressed, the slider body 2 is moved to the right and left so as to adjust the length of the waist. After that, as the pressing on the operating piece 7 is released, the operating piece 7 is restored upward by an elastic force of the elastic leg portions 73 until the small protrusions 70*a* make contact with the edge portion of the insertion hole 36. Consequently, the adjusting protrusions 11 engage with the engaging protrusions 72 so as to complete the adjustment of the waist.

In the foregoing embodiments, the vertically long through holes 23 and 71 may be formed in the central portion of the main body of the rear plate 22 and the central portion of the main body of the operating piece 7 like the other embodiments. In this case, the rear plate 22 can be fit to the surface plate 21 with the operating piece 7 inserted into the insertion hole 36 of the rear plate 22.

As understood from the above description of the embodiments, the present invention may be modified freely within a spirit thereof and is not restricted to the above described embodiments.

What is claimed is:

1. A waist adjusting device comprising an adjusting belt having a plurality of adjusting protrusions protruded from the surface thereof at a predetermined interval;

a slider body containing a hollow through portion through which said adjusting belt is capable of being inserted;

said slider body having attaching holes for attaching a fixing device provided on a face of said through portion and insertion holes through which an operating piece is capable of being inserted provided in upper and lower portions of said through portion such that said insertion holes are perpendicular to said through portion;

said operating piece having engaging protrusions capable of engaging with the adjusting protrusions and protruded on a face thereof;

wherein slope portions are provided on both sides of lower portions of said insertion holes;

wherein elastic leg portions are provided so as to be integrally on both sides of said operating piece at upper portions thereof and extending in parallel to the operating piece, each of said elastic leg portions making sliding contact with each of the slope portions and being capable of sliding thereon; and wherein said operating piece is urged upward so as to allow the adjusting protrusions and the engaging protrusions to engage with each other.

2. A waist adjusting device according to claim 1, wherein the slider body has a gap portion provided in any one of top plate and bottom plate for connecting a surface plate and a rear plate to each other; and by elastically deforming said slider body so that the gap portion is expanded, the slider body can be mounted onto the adjusting belt of which both ends are fixed and which has the adjusting protrusions disposed at a predetermined interval.

3. A waist adjusting device according to claim 1, wherein the slider body is comprised of a plate-like surface plate capable of being fixed to the waist belt and a plate-like rear plate capable of engaging with said surface plate; fitting pieces are provided on any one of the surface plate and the rear plate and engaging pieces capable of engaging with the fitting pieces are provided on the other such that they oppose each other at top and bottom of the plates; and the through portion is formed in the slider body in which the surface plate engages with the rear plate so that the adjusting belt having the adjusting protrusions disposed at a predetermined interval is capable of being inserted therethrough.

4. A waist adjusting device according to claim 3, wherein the surface plate has the attaching hole in the center thereof; the fitting piece has a hook-shaped fitting portion; the rear plate has the insertion hole for the operating piece, in the center of the engaging piece while a hook-like engaging portion is provided at an end thereof; and the slope portions are formed on both sides of the lower insertion hole in the lower engaging piece.

5. A waist adjusting device according to claim 1, wherein the elastic leg portions are disposed from a central portion of a main body of the operating piece such that they extend in parallel to the main body along substantially the same length as the main body; the engaging protrusions are provided on the main body of the operating piece such that they are protruded; an operating portion of the operating piece is always kept to be protruded from the slider body; and small protrusions are provided so that they collide with an edge portion of said insertion hole to prevent removal of the operating piece.

6. A waist adjusting device according to claim 1, wherein part of the main body of the operating piece is inserted into the lower insertion hole provided in the slider body; ends of the elastic leg portions are kept to be in contact with the slope portion and slightly opened; and the small protrusions for preventing removal of the operating piece are provided on side faces of the operating portion.

7. A waist adjusting device according to claim 1, wherein a side wall is provided on the slope portion of the slider body on the side of the surface plate so that a concave groove is formed as a whole; and the ends of the elastic leg portions of the operating piece are in contact with the concave groove and capable of sliding thereon.

8. A waist adjusting device according to claim 1, wherein the slider body is rectangular and has a rectangular through hole provided vertically in the center of a rear plate thereof; attaching holes whose inner portions are expanded are provided in the surface plate opposing the through hole; and a fixing device has attaching posts, whose ends are capable of being inserted into the attaching holes and crushed, on the rear face of a cap.

9. A waist adjusting device according to claim 1, wherein a protruded ridge is provided on an inner face of each of both edge portions along the vertically long through hole provided on the rear plate of the slider; and the operating piece has long grooves extending to lower ends along both sides of a through hole provided vertically in the center of the main body of the operating piece so that the long grooves are capable of engaging with the protruded ridges of the slider body.

10. A waist adjusting device according to claim 1, wherein the elastic leg portions provided on both sides of the operating piece are formed thinner than the surface of the main body having the engaging protrusions.

11. A waist adjusting device according to claim 1, wherein the adjusting belt, slider body, fixing device and operating piece are formed of thermoplastic resin.

* * * * *